US007339145B2

(12) United States Patent
Magnusson

(10) Patent No.: US 7,339,145 B2
(45) Date of Patent: Mar. 4, 2008

(54) APPARATUS AND A METHOD FOR INDUCTION HEATING OF PIECES OF ELECTRICALLY CONDUCTING AND NON-MAGNETIC MATERIAL

(75) Inventor: Niklas Magnusson, Klæbu (NO)

(73) Assignee: Sintef Energiforskning AS, Trondheim (NO)

( * ) Notice: Subject to any disclaimer, the term of this patent is extended or adjusted under 35 U.S.C. 154(b) by 20 days.

(21) Appl. No.: 10/542,957

(22) PCT Filed: Nov. 26, 2003

(86) PCT No.: PCT/NO03/00394

§ 371 (c)(1),
(2), (4) Date: Jul. 21, 2005

(87) PCT Pub. No.: WO2004/066681

PCT Pub. Date: Aug. 5, 2004

(65) Prior Publication Data

US 2006/0157476 A1 Jul. 20, 2006

(30) Foreign Application Priority Data

Jan. 24, 2003 (NO) ..... 20030401

(51) Int. Cl.
*H05B 6/10* (2006.01)
*C21D 9/54* (2006.01)

(52) U.S. Cl. ..... 219/645; 266/103

(58) Field of Classification Search ..... 219/645, 219/635, 646, 619, 773; 266/103, 111; *H05B 6/10; C21D 9/54*
See application file for complete search history.

(56) References Cited

U.S. PATENT DOCUMENTS

| | | | | |
|---|---|---|---|---|
| 2,912,552 | A | 11/1959 | Baermann | |
| 4,761,527 | A | 8/1988 | Mohr | |
| 4,942,750 | A * | 7/1990 | Conaway | 72/56 |
| 5,278,380 | A * | 1/1994 | Lowry | 219/635 |
| 5,781,581 | A * | 7/1998 | Fishman et al. | 373/152 |
| 7,012,214 | B2 * | 3/2006 | Schroder et al. | 219/121.36 |
| 7,179,416 | B2 * | 2/2007 | Ueno | 266/104 |
| 2006/0022387 | A1 * | 2/2006 | Ueno | 266/104 |

FOREIGN PATENT DOCUMENTS

| | | |
|---|---|---|
| NO | 47882 | 5/1930 |
| WO | WO 02/087285 A1 | 10/2002 |

* cited by examiner

*Primary Examiner*—Daniel Robinson
(74) *Attorney, Agent, or Firm*—Rothwell, Figg, Ernst & Manbeck, PC

(57) ABSTRACT

An apparatus and a method for induction heating of pieces or blanks (10) of electrically conducting and non-magnetic material, wherein a device creates a static magnetic field (3) and a second device is arranged to cause a relative movement (4) between the piece or blank (10) and the static magnetic field (3), so that current is induced (12) in the piece or blank (10) which thereby is being heated up.

7 Claims, 8 Drawing Sheets

APPARATUS AND A METHOD FOR INDUCTION HEATING OF PIECES OF ELECTRICALLY CONDUCTING AND NON-MAGNETIC MATERIAL

CROSS REFERENCE TO RELATED APPLICATION

This application is a 35 U.S.C. § 371 National Phase Entry Application from PCT/NO2003/000394, filed Nov. 26, 2003, and designating the U.S.

BACKGROUND OF THE INVENTION

1. Field of the Invention

This invention relates to an apparatus and a method for induction heating of pieces or blanks of electrically conducting and non-magnetic material.

2. Description of the Related Art

Induction heating is used in force pressing in order to soften up metal bolts or billets before they are being pressed into profiles. For non-magnetic materials which are good electrical conductors, such as aluminium, copper or brass, conventional induction heating has an efficiency of only 55-60%. In such conventional heating processes a bolt or billet is axially placed within a coil. Alternating current is applied to the coil, so that an axial alternating magnetic field is produced. Consequently counter-current is induced in the bolt or billet to counteract the magnetic field. In this case the induced current heats the press bolt or billet. The problem here is that the current in the coil causes losses that are of the same size as in the bolt or billet, which causes the efficiency to become low.

Induction heating devices can also be equipped with superconducting coils for alternating current, cf. Norwegian Patent No. 308.980. Superconductors, however, produce losses when they are exposed to an alternating magnetic field. A problem that can occur here is that the heat from the AC losses in the superconductors must be cooled away (at approximately 50-90 Kelvin), and the cooling system, that is needed, is expensive.

Recently, there have appeared possibilities for formation of a static or DC magnetic field without energy losses. Superconductors can, under DC conditions, conduct electric current practically without losses, and strong permanent magnets have become available at a reasonable price. In the solution proposed here the superconductors are substantially exposed only to a static or DC magnetic field, and therefore a substantially smaller cooling system is required, which is also cheaper than the one used in the induction heating apparatus employed in Norwegian Patent No. 308.980.

SUMMARY OF THE INVENTION

In a preferred embodiment the present invention teaches inducing electric current to heat up a material by allowing the material to be moved in a magnetic field. It is known that in an electrically conducting material, being moved orthogonal to a static magnetic field, an electric field is established being perpendicular to the direction of movement and the magnetic field. The electric field induces currents which then cause resistive losses that are heating up the material.

In the same way, currents are induced in an electrically conducting material if it is moved in the direction of the static field when the intensity of the field is also varied in the same direction.

In a typical embodiment of the invention a workpiece, blank or bolt, for example a cylindrical press bolt or billet of good electrically conduction and non-magnetic material, is rotated in a static magnetic field orientated perpendicular to the axis of the bolt or billet. The static magnetic field can for example be created by applying a DC current through a superconductor or by using permanent magnets. It is also possible to combine permanent magnets and superconductors in order to generate a static magnetic field. The energy, that is used for the heating up, is provided by means of a motor or the like which drives the device creating a relative movement. For example a rotating or linear electrical motor can be used. In the proposed rotating induction heating apparatus the degree of efficiency of the heating process is mainly determined by the efficiency of the motor providing the rotation. An electrical motor has a typical efficiency of 90% or more, which is substantially better than the 55-60% considered for conventional induction heaters for aluminium, copper or brass bolts or billets.

When superconductors are used in the induction heating apparatus according to the invention, the effect in the piece, blank, bolt or billet can be controlled by varying the level of the magnetic field. In the same way it can be controlled which area of the piece, blank, bolt or billet to be most heated by connecting coils that are wound on different places along the axis of the piece, blank, bolt or billet.

The degree of efficiency is affected to a very little extent when the dimensions of the piece, blank, bolt or billet are changed.

It is further possible to combine the static magnetic field with an alternating magnetic field in order to create a common magnetic field arranged to heat up the electrically conducting and non-magnetic piece or blank.

Instead of moving linear or rotating the piece or blank, the device, creating the static magnetic field, can be moved linear or rotated.

The novel and characteristic features of the invention are stated more closely in the claims.

The most important advantage of the apparatus and the method according to the present invention is that the degree of efficiency can be considerably increased. It goes up from approximately 55-60% to 90% or more in relation to conventional methods. This is obviously quite considerable and shows that it is here a matter of a new solution of high practical value to the industry.

In what follows the invention will be explained more closely with reference to the drawings which schematically and simplified show different embodiments that are practically possible.

DETAILED DESCRIPTION OF THE INVENTION

Figure 1:
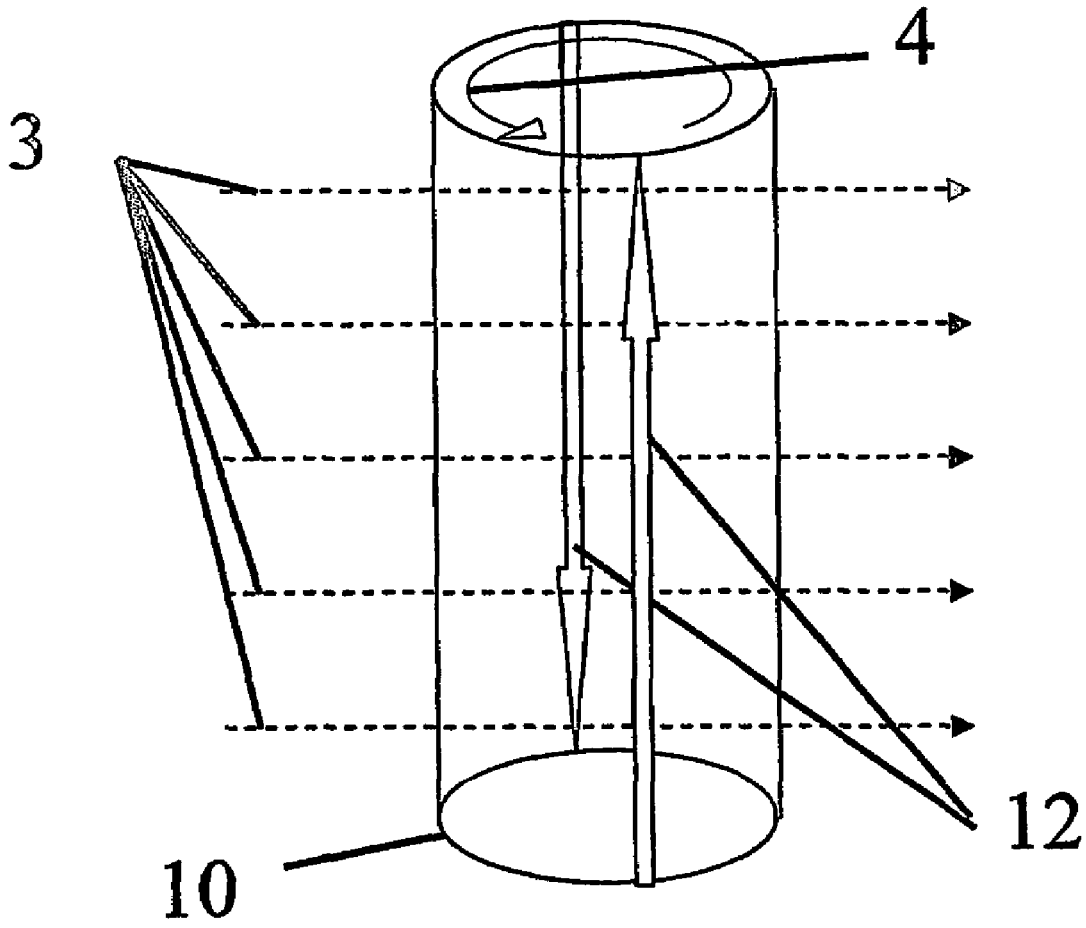
FIG. 1 shows schematically an embodiment of an apparatus according to the invention.

FIG. 1 shows schematically an apparatus where a piece or blank 10, for example a cylindrical press bolt or billet of electrically well conductive and non-magnetic material is rotated 4 in a static magnetic field 3 orthogonally orientated in relation to the axis of the piece or blank. In the rotating piece or blank 10 there is set up an electrical field being orthogonal in relation to the direction of movement 4 and the magnetic field 3. The electrical field induces currents 12 in the piece or blank 10 which then give resistive losses heating up the piece or blank 10.

Figure 2:
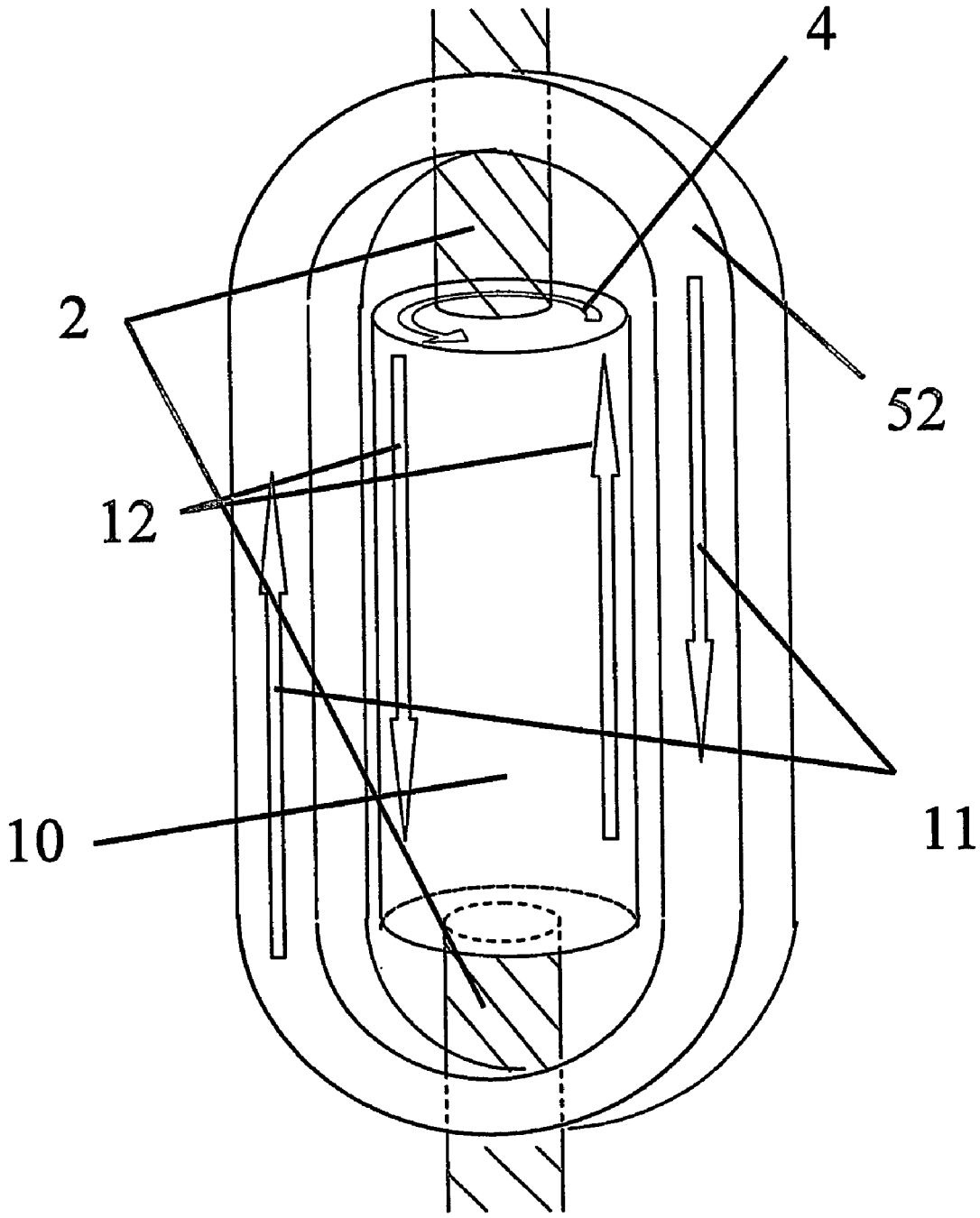
FIG. 2 shows an embodiment according to the invention comprising a coil that creates a static magnetic field, where the piece or blank is rotated.

FIG. 2 shows an apparatus for induction heating of the piece or blank 10 of electrically conducting and non-magnetic material, comprising a device for creating of a static magnetic field and a device 2 arranged to cause a relative movement 4 between the piece or blank 10 and the static magnetic field. The device for creating of the static magnetic field comprises a coil 52. The magnetic field is created by applying a direct current 11 to the coil 52 and in combination with the rotational movement 4 of the piece or blank 10 currents 12 are induced in piece or blank 10 giving resistive losses thereby heating up the piece or blank 10. The coil 52 can have windings which can be of superconducting material. The device for movement/rotation comprises two shafts or spindles 2 gripping in towards the end sections of the piece or blank 10.

Figure 3A:
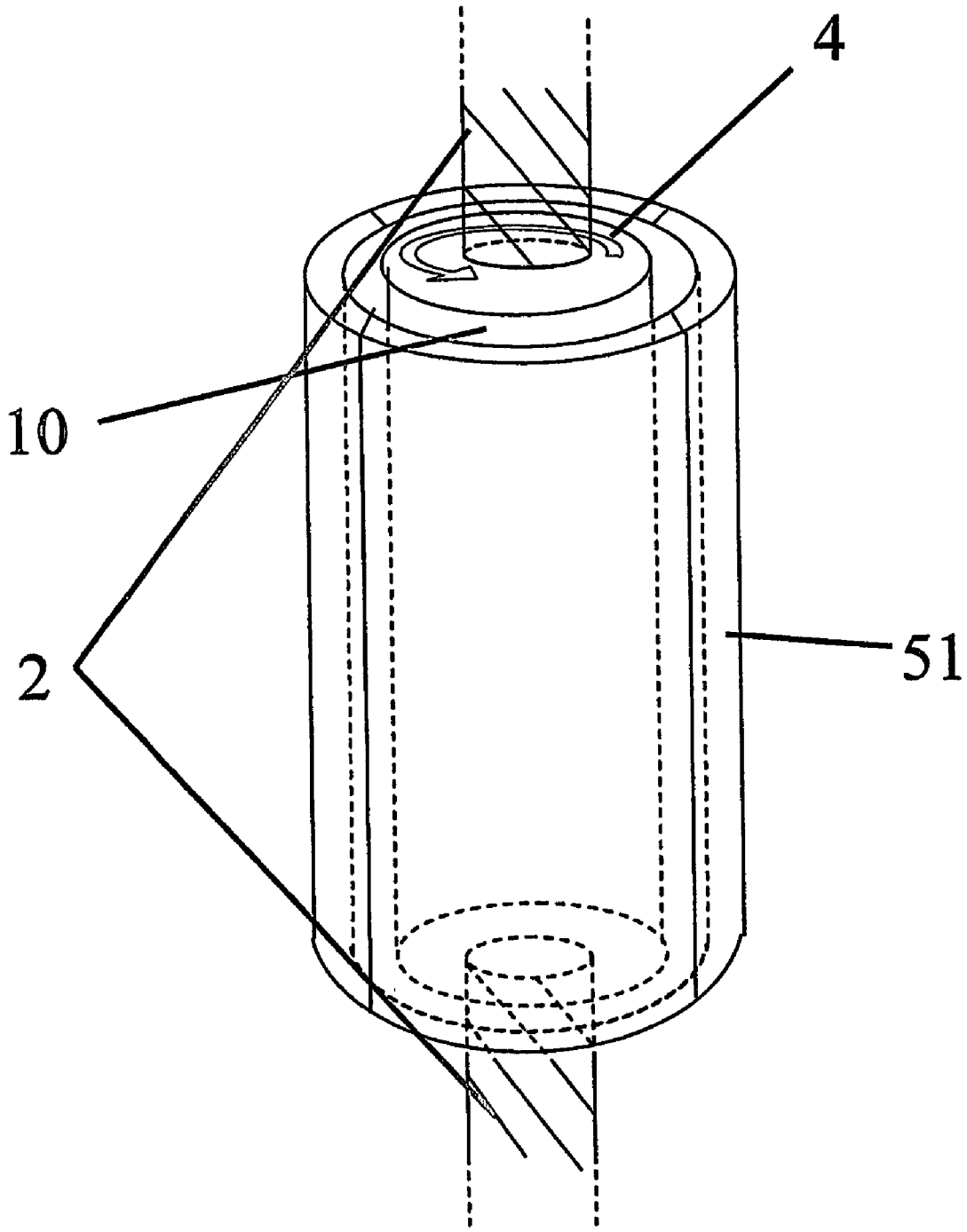
FIG. 3*a* shows an alternative embodiment according to the invention comprising permanent magnets surrounding the piece or blank, where the piece or blank is rotated.
Figure 3B:
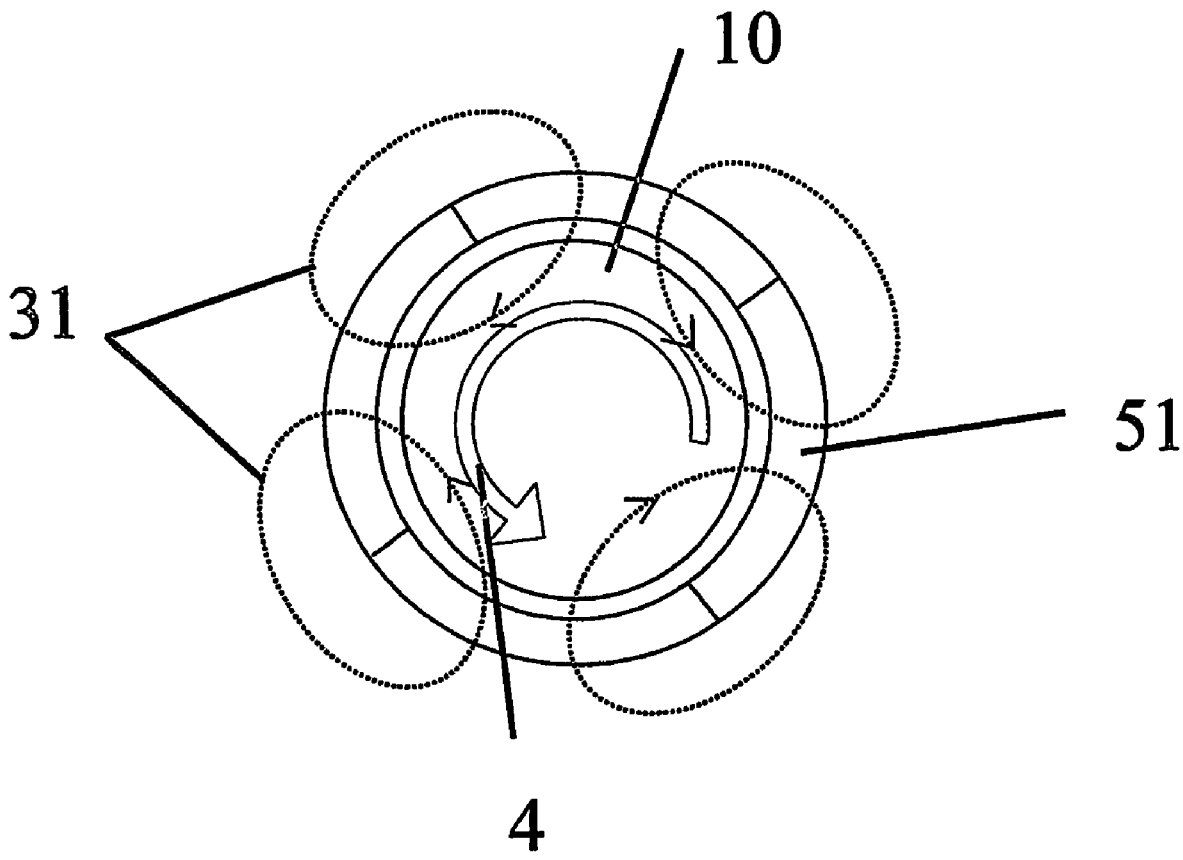
FIG. 3*b* shows a horizontal cross section of FIG. 3*a*, where the magnetic lines are indicated.
Figure 3C:
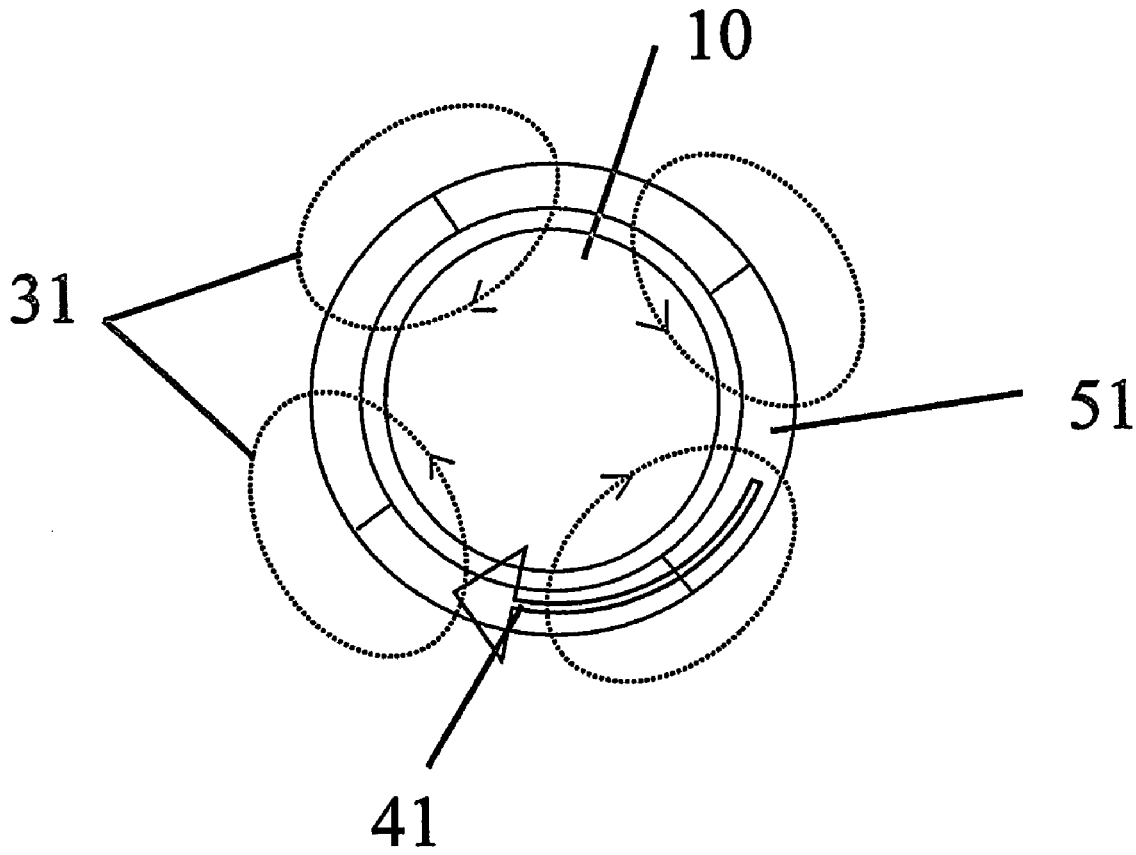
FIG. 3*c* shows a horizontal cross section of a third embodiment according to the invention comprising permanent magnets surrounding the piece or blank, where the permanent magnet device creating the static magnetic field is rotated.

On FIG. 3*a* an alternative embodiment according to the invention is illustrated, where the device creating the magnetic field comprises permanent magnets 51 and which in this case surrounds the piece or blank 10. The annular permanent magnet device 51 comprises several poles, for example four, so that the magnetic field 31, that is created, will be directed into and out of the piece or blank 10 several times along its periphery, since the spindle device 2 as shown on FIG. 2 is arranged to cause a relative rotational movement 4 between the piece or blank 10 and the static magnetic field 31. The magnetic lines of the static magnetic field 31 are shown on FIGS. 3*b* and 3*c*. FIG. 3*c* illustrates however a cross section of a third embodiment according to the invention, where the device for creating of the magnetic field is being rotated 41, and the piece or blank 10 is stationary.

Figure 3D:
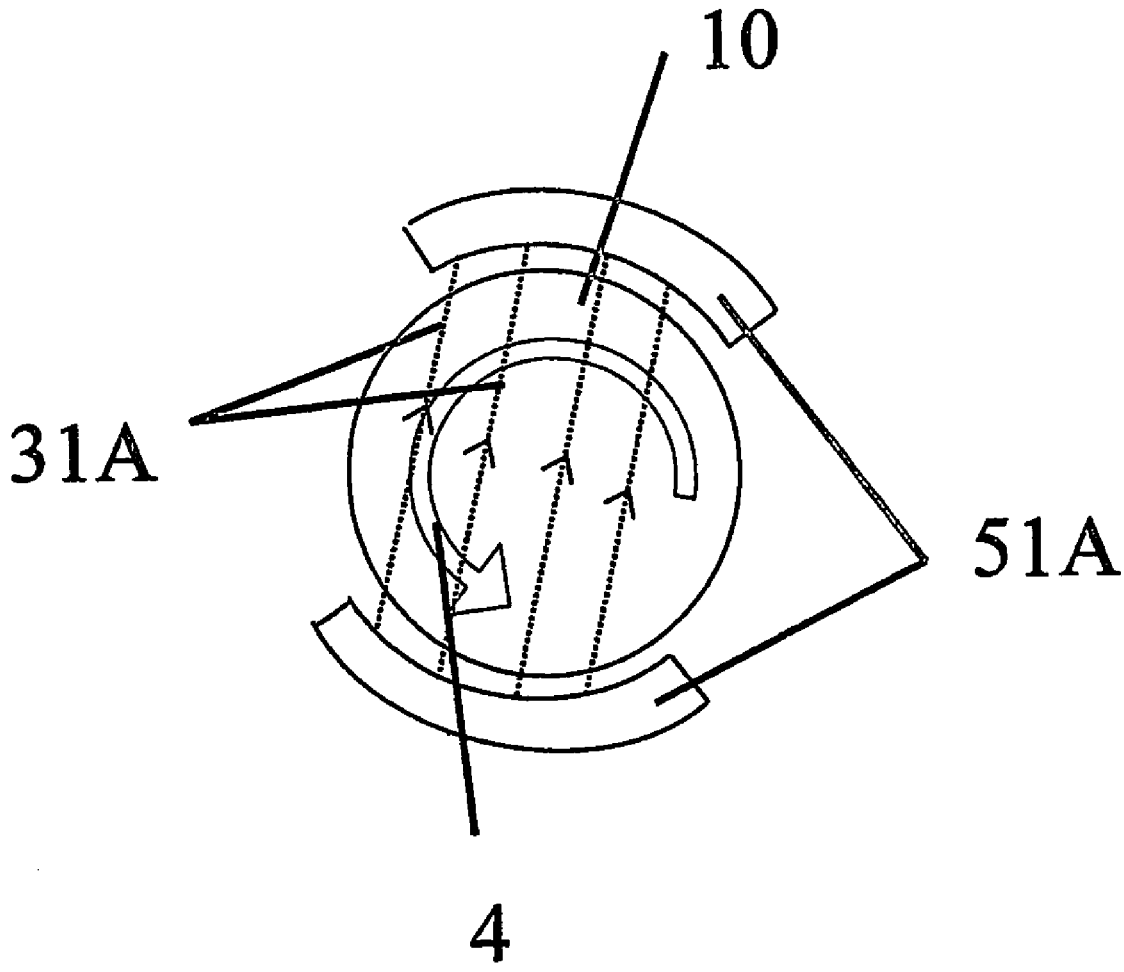
FIG. 3*d* shows a horizontal cross section of a fourth embodiment according to the invention comprising permanent magnets which do not surround the piece or blank.

FIG. 3*d* shows a fourth embodiment according to the present invention, where the device for creating of the magnetic field 31A comprises a more open arrangement of permanent magnets 51A which do not surround the piece or blank 10. In this case it is preferred to rotate 4 the piece or blank 10.

Figure 4A:
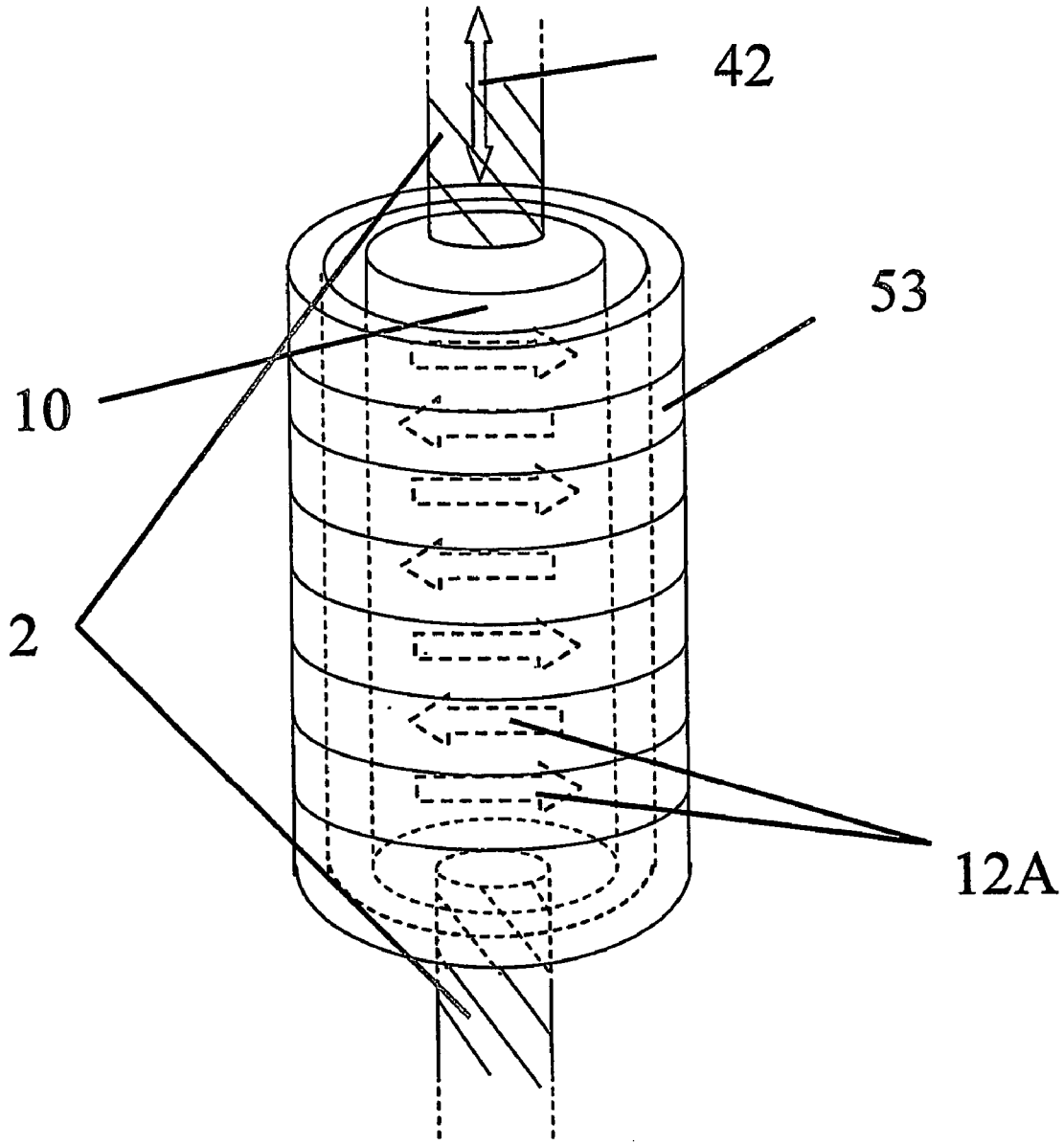
FIG. 4*a* shows a fifth embodiment according to the invention comprising a coil having annular sections surrounding the piece or blank and being connected in anti-parallel, where piece or blank is moved linear and where the currents induced in the piece or blank are indicated.
Figure 4B:
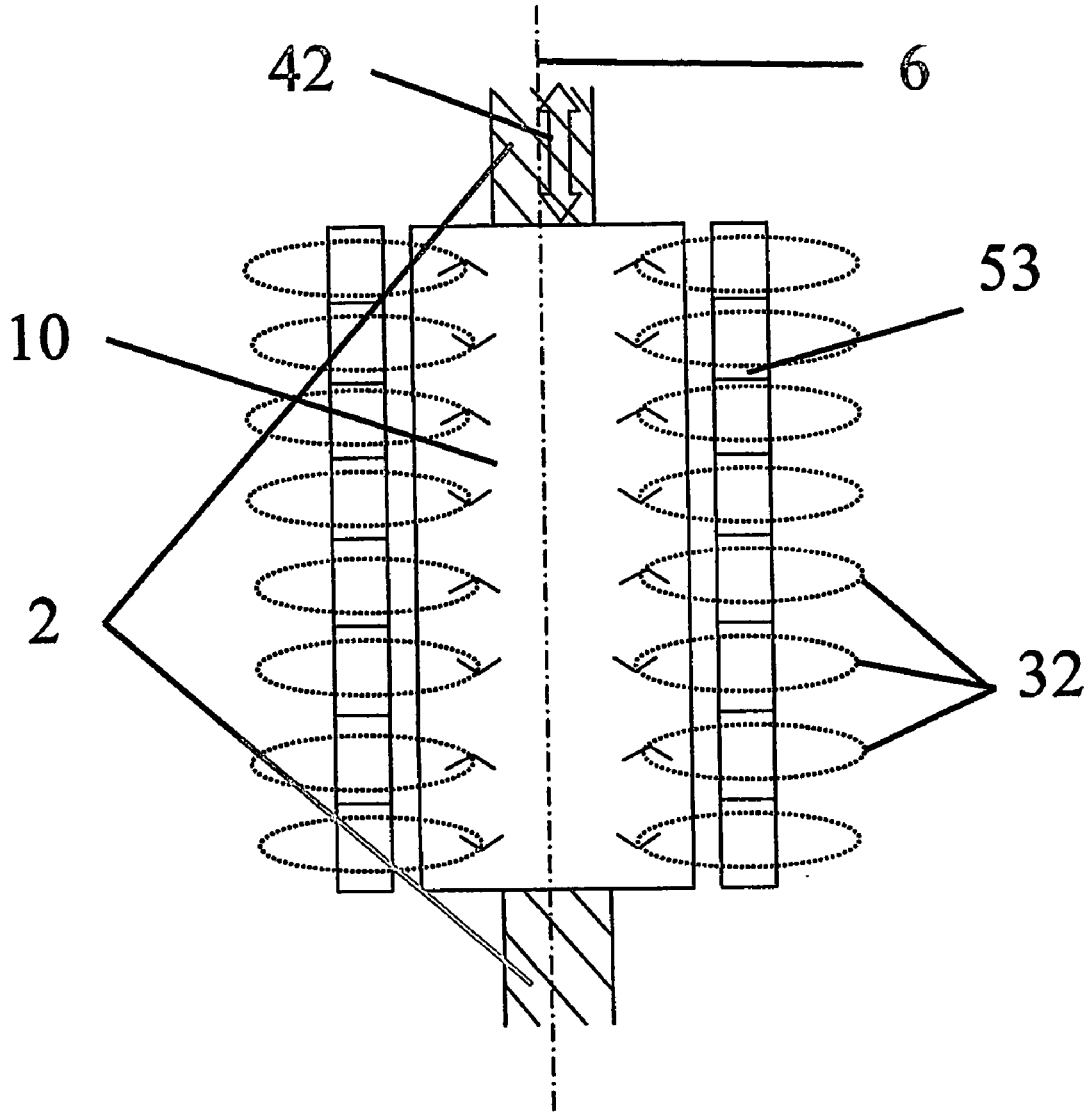
FIG. 4*b* shows a vertical cross section of FIG. 3*a*, where the magnetic lines are shown.

A fifth embodiment according to the invention shown on FIGS. 4*a* and 4*b*, comprises a coil 53 having annular sections surrounding the piece or blank 10 and being connected in anti-parallel, so that the static magnetic field 32, which is created, varies in axial direction, since the device 2 for relative movement is arranged to cause a relative linear movement 42 in the same axial direction between the piece or blank 10 and the static magnetic field 32. The piece or blank 10 is being heated up by the induced currents 12A. The coil 53 can advantageously have windings of superconducting material. Instead of a coil 53 it is also possible to use permanent magnets in a similar annular and sectionized device for creation of the static magnetic field 32.

According to the invention the device for creation of relative movement can rotate or move linearly along the axis 6 of the piece or blank 10, i.e. either the piece or blank 10 in relation to the static magnetic field or the device for creation of the static magnetic field in relation to the piece or blank 10 which is stationary. It is possible to relatively move both the device for creation of the field and the piece or blank in relation to each other, but this is complicated and therefore is not preferred.

In the device creating the magnetic field it is possible to use a combination of both permanent magnets and windings/coils.

Additionally the described apparatus for induction heating can comprise a device for creation of an alternating magnetic field, so that the static magnetic field, mentioned before, is combined with the alternating magnetic field thereby having a total or common effect on the piece or blank 10.

The invention claimed is:

1. Apparatus for induction heating of pieces or blanks of electrically conducting and non-magnetic material, comprising:

a device for creating a static magnetic field comprising at least one coil comprising windings of superconducting material;

means for applying a direct current to said at least one coil; and a device for causing a relative rotational movement between the piece or blank and the static magnetic field, so that current is induced in the piece or blank which thereby is being heated up.

2. Apparatus according to claim 1, wherein the at least one coil adapted to entirely or partially surround the piece or blank.

3. Apparatus according to claim 1, wherein the device for creating of the static magnetic field further comprises at least one permanent magnet.

4. Apparatus according to claim 3, wherein the at least one permanent magnet is included in an annular permanent magnet device arranged to surround the piece or blank.

5. Apparatus according to claim 1, wherein the device for relative movement is arranged to move the piece or blank in relation to the static magnetic field.

6. Apparatus according to claim 1, wherein the device for relative movement is arranged to move the device for creation of the static magnetic field in relation to the piece or blank.

7. Apparatus according to claim 1, further comprising a device for creation of an alternating magnetic field, so that the static magnetic field is combined with the alternating magnetic field thereby having a common effect on the piece or blank.

* * * * *